US005730289A

United States Patent [19]

Cappels

[11] Patent Number: 5,730,289

[45] Date of Patent: Mar. 24, 1998

[54] BOX AND INSERT FOR SHIPPING GLASS BOTTLES

[76] Inventor: Bruce Cappels, 340 E. 64th St., Apt. 16B, New York, N.Y. 10021

[21] Appl. No.: 613,485

[22] Filed: Mar. 11, 1996

[51] Int. Cl.[6] ..... B65D 75/00

[52] U.S. Cl. ..... 206/434; 206/418; 206/504; 229/89; 229/90; 229/915

[58] Field of Search ..... 206/418, 421, 206/422, 434, 718, 723, 775, 782, 783, 504, 430; 229/89, 90, 117.04, 117.03, 121, 915

[56] References Cited

U.S. PATENT DOCUMENTS

| | | | |
|---|---|---|---|
| 1,449,532 | 3/1923 | Moore | 206/422 |
| 2,667,267 | 1/1954 | Amatel | 206/422 |
| 2,723,795 | 11/1955 | Mac Kenzie | 206/418 |
| 3,680,726 | 8/1972 | Massey | 229/89 |
| 5,358,170 | 10/1994 | Van Hest | 206/418 |

FOREIGN PATENT DOCUMENTS

| | | | |
|---|---|---|---|
| 973753 | 2/1951 | France | 206/418 |
| 1042137 | 10/1953 | France | 206/418 |
| 1485701 | 5/1967 | France | 206/434 |
| 2661892 | 11/1991 | France | 229/915 |
| 332450 | 7/1930 | United Kingdom | 206/418 |
| 412609 | 12/1933 | United Kingdom | 229/89 |

*Primary Examiner*—David T. Fidei
*Attorney, Agent, or Firm*—Brown, Pinnisi & Michaels

[57] ABSTRACT

Disclosed herein is a box insert for protecting bottles. The box insert is formed from a piece of cardboard with fold lines. When the cardboard is folded along the lines and a bottle is placed within the cardboard, the bottle's sides are surrounded by cardboard. At least one bottom and top cut am provided through the cardboard across one of the fold lines. When the cardboard is pushed below the bottom cut and above the top cut, the cardboard folds inward to create a bottom and top indentation to hold the bottle away from the bottom and top of the box. If the bottle has a neck, the top indentation is positioned next to the bottle's neck above the body of the bottle. Usually the top indentation is formed from two top cuts. The inserts and bottles are then placed in a box for shipping. The cardboard inserts provide cardboard indentations that cushion and provide a small space between the bottom and top of the box. The bottle is prevented from moving up and down by the indentations and in the event the box is dropped the box and insert receive the force of the blow rather than the bottles. In the preferred embodiment the piece of cardboard also include with fold lines, such that when the cardboard is folded along the lines at least two bottles can be surrounded by the cardboard and there are sufficient bottom and top cuts to form at least one bottom and top indentation for each of the bottles. The preferred embodiment also includes cut lines to form tabs that interact to hold the insert in a folded position.

10 Claims, 3 Drawing Sheets

BOX AND INSERT FOR SHIPPING GLASS BOTTLES

FIELD OF THE INVENTION

The invention pertains to the field of boxes for shipping articles. More particularly, the invention pertains to boxes for shipping glass bottles

BACKGROUND OF THE INVENTION

Traditionally, liquor and wine bottles are shipped in cardboard boxes with thin cardboard separating the bottles from one another. These inserts merely prevent the glass from one bottle directly contacting the glass of the other bottles. Very little impact absorbing protection is provided: Furthermore, in these traditional shipping boxes the bottles can move freely up and down, such that if the box is dropped or set down quickly the bottoms or tops of the bottles receive a great deal of force and frequently shatter.

When greater protection is desired for wines or liquors, Styrofoam shippers are often used. However, Styrofoam is expensive and bulky. Furthermore, Styrofoam is difficult to recycle and can add significant weight to the package thereby increasing shipping costs. There is a need for a low cost protection for bottles that can be easily stored and constructed when needed.

SUMMARY OF THE INVENTION

The present invention solves the problems associated with shipping liquor and wine bottles by providing an insert that prevents the bottles from moving within the box and cushions the bottles in the event a box is dropped or otherwise handled harshly.

The box insert is formed from a piece of cardboard with fold lines. When the cardboard is folded along the lines and a bottle is placed within the cardboard, the bottle's sides are surrounded by cardboard. At least one bottom and top cut are provided through the cardboard across one of the fold lines. When the cardboard is pushed below the bottom cut and above the top cut, the cardboard folds inward to create a bottom and top indentation to hold the bottle away from the bottom and top of the box. If the bottle has a neck, the top indentation is positioned next to the bottle's neck above the body of the bottle. Usually the top indentation is formed from two top cuts.

In the preferred embodiment the insert protects at least two bottles. The cardboard has enough folds such the both bottles are surrounded by the cardboard and there are sufficient bottom and top cuts to form at least one bottom and top indentation for each of the bottles. The cardboard also includes cut lines to form tabs that interact to hold the insert in a folded position.

The inserts and bottles are then placed in a box for shipping. The indentations cushion the bottles and provide a small space between the bottom and top of the box. The bottle is prevented from moving up and down by the indentations and in the event the box is dropped the box and insert receive the force of the blow rather than the bottles. The inserts can be used in various combinations for shipping bottle of liquor. For example, the inserts could be used for shipping gift boxes of wine of 1, 2 or 3 bottles, as well as more standard 12 bottle cases and other combinations desired by the user.

DETAILED DESCRIPTION

The present invention solves the problems associated with shipping liquor and wine bottles by providing an insert that prevents the bottles from moving within the box and cushions the bottles in the event a box is dropped or otherwise handled harshly.

Figure 1A:
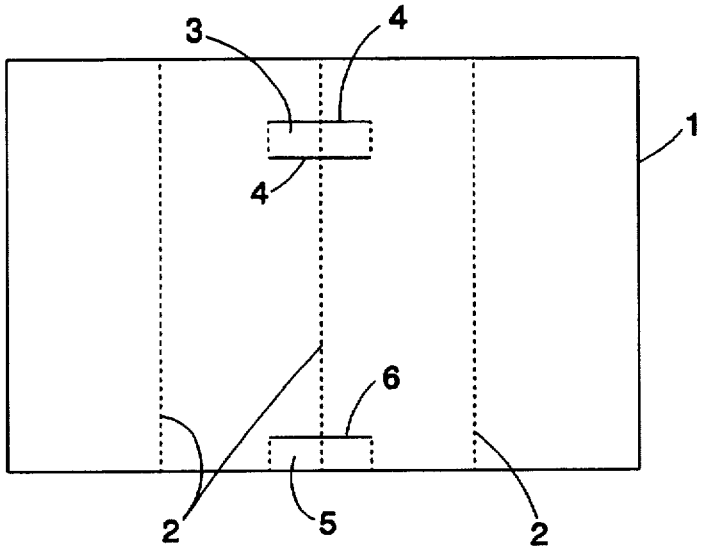
FIGS. 1*a* and 1*b* show an insert of the present invention for a one and two bottle box folded flat with the fold lines and the cut lines for the indentations marked.
Figure 1B:
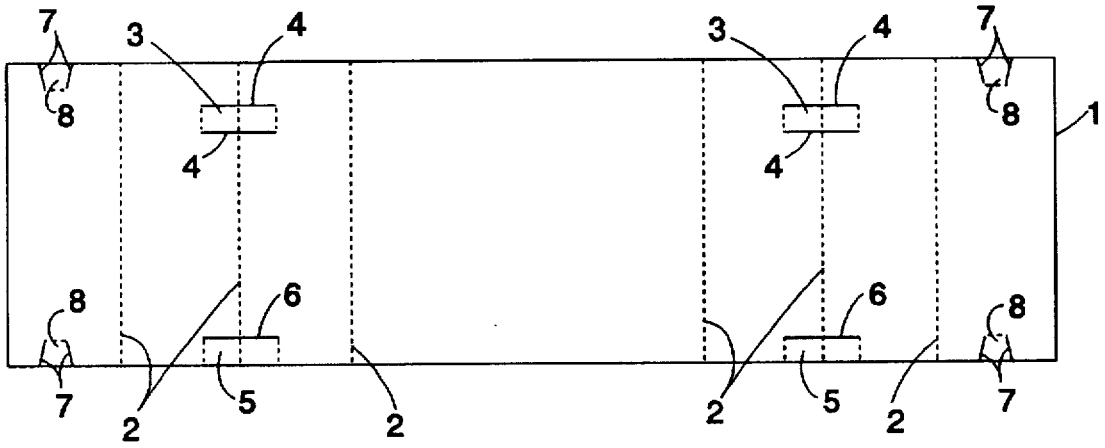

Referring now to FIGS. 1*a* and 1*b*, an insert (1) of the present invention for a one and two bottle box is shown folded flat with the fold lines (2) marked. The insert (1) is made of cardboard, preferably an open-cell or other type of cardboard suitable for cushioning shock. The cardboard is folded along the fold lines (2) to surround a bottle. The term "fold line" is used herein to describe a guide for folding the cardboard. The preferred embodiment is to perforate the cardboard along the folds to allow for easy folding, but other means for scoring the cardboard could be used.

Figure 2A:
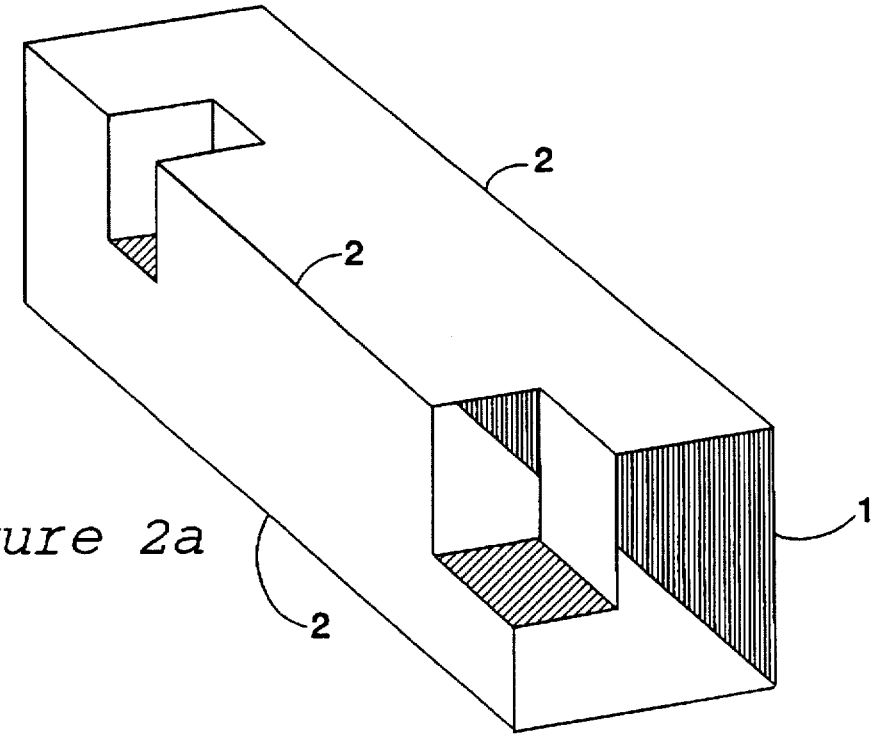
FIGS. 2*a* and 2*b* show inserts of the present invention for a one and two bottle box folded up for use with the indentations folded out for holding a bottle.
Figure 2B:
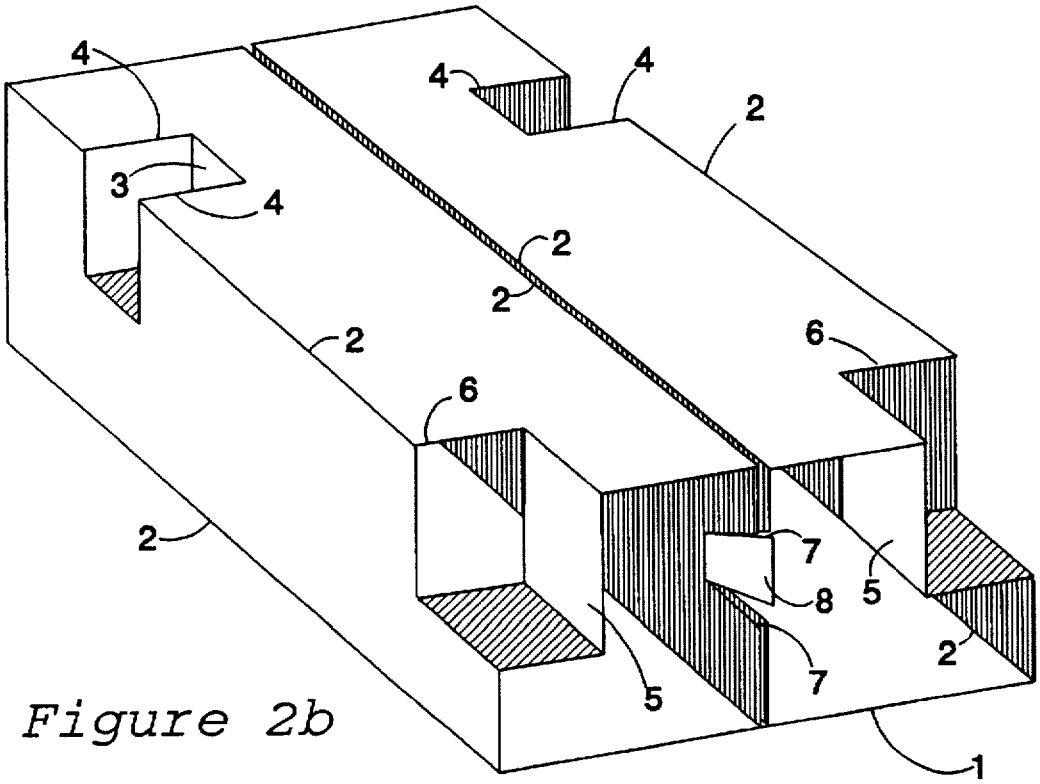

Folded inserts are shown in FIGS. 2*a* and 2*b*. When a bottle is placed within the cardboard, the bottle's sides are surrounded by cardboard. The term "cut line" is used herein to describe a line along which the cardboard will be severed when in use. The preferred embodiment is to provide a perforation along the cut line so the user may sever the cardboard during assembly.

A top indentation (3) is formed by two top cuts (4). A similar bottom indentation (5) is formed by a bottom cut (6), but only one cut (6) is needed because the indentation (5) is directly on the bottom of the insert (1). When the cardboard is pushed in on the corner below the bottom cut (6) and between the top cuts (4), the cardboard folds inward to create the bottom and top indentation (3) and (5). These indentations (3) and (5) hold the bottle away from the bottom and top of the box. If the bottle has a neck, the top indentation (4) is positioned next to the bottle's neck above the body of the bottle. Usually the top indentation (4) is formed from two top cuts (3), but could be formed in a similar fashion to the bottom indentation (5) if the bottles did not have necks.

In the preferred embodiment, the piece of cardboard can protect at least two bottles as shown in FIGS. 1*b* and 2*b*. The cardboard is still folded inward and there are sufficient bottom and top cuts (4) and (6) to form at least one bottom and top indentation (3) and (5) for each of the bottles. For this embodiment, the piece of cardboard also includes tab cut lines (7) on the top and bottom of the insert (1) to form tabs (8) that interact to hold the insert (1) in a folded position.

Figure 3:
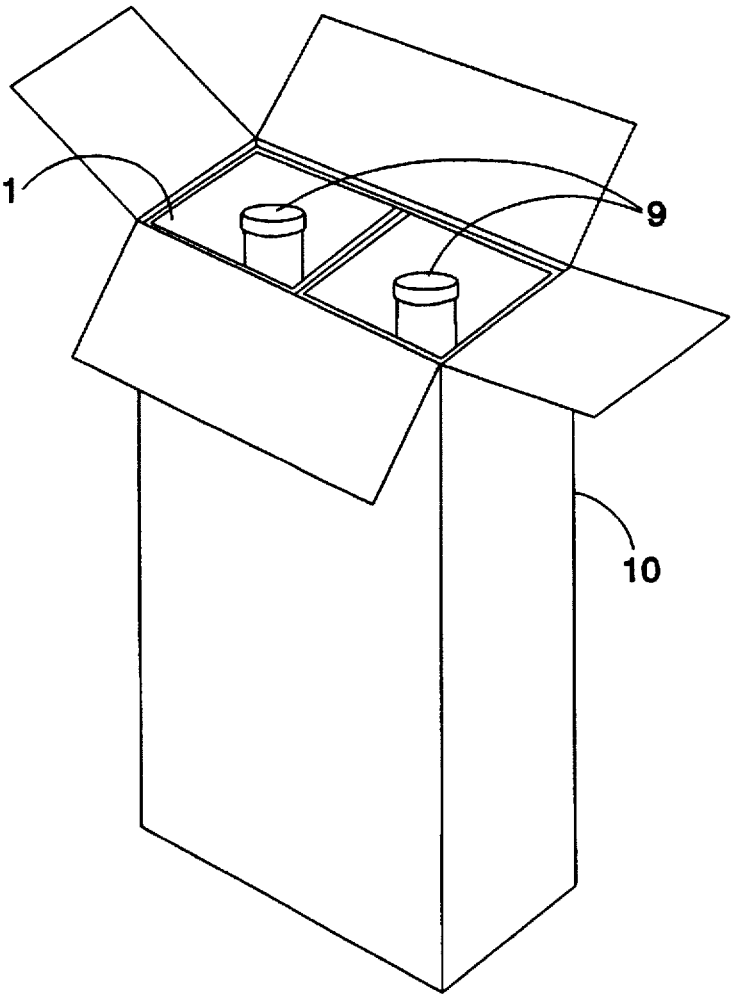
FIG. 3 shows an insert of the present invention folded up for use and holding bottles within a two bottle box.

To use an insert (1) of the present invention, the cardboard is folded inwardly at all fold lines (2). In the preferred two bottle insert (I), the two tabs (8) at the top and bottom of the insert (1) are folded to the left or right to hold the insert (1) in the folded position. Then the bottom indentations are formed (5) by pushing on the corners below the bottom cuts (6) and the bottles (9) are placed in the in the insert (1). The top indentations (3) are formed by pushing on the corners above or between the top cuts (4).The inserts (1) and bottles (9) are then placed in a box (10) for shipping as shown in FIG. 3.

The cardboard indentations (3) and (5) cushion the bottle (9) and provide a small space between the bottom and top of the box (10). The bottle (9) is prevented from moving up and down by the indentations (3) and (5). In the event the box (10) is dropped, the box (10) and insert (1) receive the force of the blow rather than the bottles (9). The box (10) can be made a little wider and taller to accommodate the insert (1).

More than one insert (1) may be used within a box (10). For example, a normal case of wine has twelve bottles (9), so six inserts (1) could be arranged within the box (10) such that each bottle (9) is protected by at least two layers of cardboard on the side. The one and two bottle inserts (1) can be combined to ship almost any number of bottles within a box. For example, a one and two bottle insert (1) can be combined in a box (10) to ship a 3 bottle gift box of wine.

The advantages of the present invention are numerous. The inserts (1) store flat and take up very little space when compared to Styrofoam shippers for a similar purpose.

The cardboard weighs less, is more durable, is about half the cost and is better environmentally than the Styrofoam shippers.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A box and insert for protecting bottles capable of holding at least five hundred milliliters of liquid within said bottles, comprising:

a) a box for shipping said bottles that is at least slightly taller than said bottles; and b) an insert placed inside said box, surrounding at least one bottle such that said bottle is protected by at least two layers cardboard on each side, wherein said insert includes:

i) a piece of cardboard with fold lines, such that when said cardboard is folded along said lines and a bottle is placed within said cardboard, said bottle's sides are surrounded by cardboard, ii) at least one bottom cut through said cardboard across one of said fold lines, such that when said cardboard is folded to surround a bottle and is pushed below said bottom cut along the fold line crossed by said bottom cut said cardboard folds inward to create a bottom indentation wherein said cardboard forming said bottom indentation is of sufficient strength to hold said bottle's bottom away from said box for shipping when said bottle is in a vertical position, and iii) at least one top cut through said cardboard across one of said fold fines, such that when said cardboard is folded to surround a bottle and is pushed above said top cut along the fold line crossed by said top cut said cardboard folds inward to create a top indentation to hold said bottle's top away from said box for shipping.

2. The box and insert of claim 1 wherein said bottle has a neck that is smaller in diameter than a main portion of said bottle and said top cut is positioned such that said top indentation is next to said bottle's neck above said bottle's main portion.

3. The box and insert of claim 2 wherein said top indentation is formed from two top cuts.

4. The box and insert of claim 1 wherein said piece of cardboard also include with fold lines, such that when said cardboard is folded along said lines at least two bottles can be surrounded by said cardboard and there are sufficient bottom and top cuts to form at least one bottom and top indentation for each of said bottles.

5. The box and insert of claim 4 wherein said piece of cardboard also includes cut lines to form tabs that interact to hold said insert in a folded position.

6. A shipping system, comprising:

a) a bottle capable of holding at least five hundred milliliters of liquid within said bottle b) a box for shipping said bottle that is at least slightly taller than said bottle; and c) an insert placed inside said box, including:

i) piece of cardboard with fold lines, such that when said cardboard is folded along said lines and said bottle is placed within said cardboard, said bottle's skies are surrounded by cardboard, ii) at least one bottom cut through said cardboard across one of said fold lines, such that when said cardboard is folded to surround a bottle and is pushed below said bottom cut along the fold line crossed by said bottom cut said cardboard folds inward to create a bottom indentation to hold said bottle's bottom away from said box for shipping, and iii) at least one top cut through said cardboard across one of said fold lines, such that when said cardboard is folded to surround a bottle and is pushed above said top cut along the fold line crossed by said top cut said cardboard folds inward to create a top indentation to hold said bottle's top away from said box for shipping.

7. The shipping system of claim 6 wherein said bottle has a neck that is smaller in diameter than a main portion of said bottle and said top cut is positioned such that said top indentation is next to said bottle's neck above said bottle's main portion.

8. The shipping system of claim 7 wherein said top indentation is formed from two top cuts.

9. The shipping system of claim 6 wherein said piece of cardboard also include with fold lines, such that when said cardboard is folded along said lines at least two bottles can be surrounded by said cardboard and there are sufficient bottom and top cuts to form at least one bottom and top indentation for each of said bottles.

10. The shipping system of claim 9 wherein said piece of cardboard also includes cut lines to form tabs that interact to hold said insert in a folded position.

* * * * *